US009696051B2

(12) United States Patent
Nakai et al.

(10) Patent No.: US 9,696,051 B2
(45) Date of Patent: Jul. 4, 2017

(54) AIR CONDITIONER

(71) Applicant: MITSUBISHI ELECTRIC CORPORATION, Tokyo (JP)

(72) Inventors: So Nakai, Tokyo (JP); Takayuki Nishiguchi, Tokyo (JP)

(73) Assignee: Mitsubishi Electric Corporation, Tokyo (JP)

( * ) Notice: Subject to any disclaimer, the term of this patent is extended or adjusted under 35 U.S.C. 154(b) by 145 days.

(21) Appl. No.: 14/413,388

(22) PCT Filed: Sep. 4, 2013

(86) PCT No.: PCT/JP2013/073821
§ 371 (c)(1),
(2) Date: Jan. 7, 2015

(87) PCT Pub. No.: WO2014/097686
PCT Pub. Date: Jun. 26, 2014

(65) Prior Publication Data

US 2015/0176850 A1 Jun. 25, 2015

(30) Foreign Application Priority Data

Dec. 19, 2012 (JP) ..... 2012-277004

(51) Int. Cl.

| | |
|---|---|
| ***F24F 7/00*** | (2006.01) |
| ***F24F 13/08*** | (2006.01) |
| ***F24F 7/007*** | (2006.01) |
| ***F24F 13/14*** | (2006.01) |
| ***F24F 1/00*** | (2011.01) |
| ***F24F 13/00*** | (2006.01) |

(52) U.S. Cl.
CPC ..... *F24F 7/007* (2013.01); *F24F 1/0011* (2013.01); *F24F 13/00* (2013.01); *F24F 13/1426* (2013.01); *F24F 2013/1446* (2013.01)

(58) Field of Classification Search
CPC ..... F24F 7/007; F24F 1/0011; F24F 13/00; F24F 13/1426
USPC ..... 454/329, 290, 251; 62/303
See application file for complete search history.

(56) References Cited

U.S. PATENT DOCUMENTS

2012/0171947 A1* 7/2012 Takeda ..... F24F 1/0007 454/251

FOREIGN PATENT DOCUMENTS

| | | | |
|---|---|---|---|
| EP | 1381797 | A1 | 1/2004 |
| EP | 2202468 | A1 | 6/2010 |
| EP | 2405206 | A1 | 1/2012 |
| JP | 8-247491 | A | 9/1996 |
| JP | 2004-308930 | A | 11/2004 |

(Continued)

*Primary Examiner* — Helena Kosanovic
(74) *Attorney, Agent, or Firm* — Birch, Stewart, Kolasch & Birch, LLP

(57) ABSTRACT

An air conditioner includes: a stepped portion provided on a side of an outlet of an air passage wall; an air passage extension having a rotary shaft in the outlet, the air passage extension being rotatable in an opening direction about the rotary shaft to bring a rear end into abutment with the stepped portion in such a manner that the air passage extension integrates with the air passage wall to form a curved surface of a predetermined curvature; and a rotary mechanism configured to cause the air passage extension to rotate in such a manner as to bring the rear end into abutment with the stepped portion when the air conditioner is put into operation.

1 Claim, 5 Drawing Sheets

(56) References Cited

FOREIGN PATENT DOCUMENTS

| | | | |
|---|---|---|---|
| JP | 2008-175431 | A | 7/2008 |
| JP | 2009-186046 | A | 8/2009 |
| JP | 2009-222302 | A | 10/2009 |
| JP | 2010-145059 | A | 7/2010 |
| JP | 2011-169524 | A | 9/2011 |
| WO | WO 2010/143378 | A1 | 12/2010 |

* cited by examiner

CONVENTIONAL ART

AIR CONDITIONER

TECHNICAL FIELD

The present invention relates to air conditioners configured to guide air by an air passage wall disposed inside a housing through an outlet to the outside.

BACKGROUND ART

Conventionally, in the housing of an existing air conditioner, an air passage wall is disposed so as to guide air sent from a fan through an outlet to the outside to blow an airflow far. An optimal curvature is defined for the air passage wall for blowing the airflow far, and the curved surface of the air passage wall is designed according to the curvature.

CITATION LIST

Patent Document

Patent Document 1: JP 2011-169524 A

SUMMARY OF THE INVENTION

Problems to be Solved by the Invention

However, in an air conditioner 101 with a main body of a smaller height dimension as depicted in FIGS. 6(*a*) and 6(*b*), for example, a sufficient length of an air passage wall 102 is not ensured. Hence, there is a problem such that as depicted in FIG. 6(*b*), an airflow is not blown far.

Meanwhile, as depicted in FIGS. 6(*a*) and 6(*b*), movable flaps 104 and 105 for controlling the airflow are provided at an outlet 103 of the air conditioner 101 (for example, see Patent Document 1). It may be considered to forcibly blow the airflow far using these movable flaps 104 and 105. In this case, however, there is a problem such that a highly efficient operation cannot be achieved due to a large pressure loss caused by, for example, a gap or level difference between the air passage wall 102 and the movable flaps 104 and 105.

The present invention has been made to solve the foregoing problems, and an object of the invention is to provide an air conditioner in which a sufficient length for an air passage is ensured to blow the airflow far in operation to be capable of achieving a highly efficient operation.

Means for Solving the Problems

An air conditioner according to the present invention includes: an air passage extension that has a first rotary shaft in an outlet, and that rotates in an opening direction about the first rotary shaft to constitute a curved surface of a predetermined curvature by integration with the air passage wall; a rotary mechanism that rotates the air passage extension when an operation is performed; and a flap that has a second rotary shaft in the outlet to guide the air sent from the fan to the outside, and that is entirely covered with the air passage wall from a blowing side when the air passage extension is closed.

Further, an air conditioner according to the present invention includes: a stepped portion provided on a side of an outlet of an air passage wall; an air passage extension that is movable to the inside and outside of a housing, and that moves to an outer side of the housing and brings an end of the extension into abutment with the stepped portion to constitute a curved surface of a predetermined curvature by integration with the air passage wall; and a moving mechanism that moves the air passage extension to bring the end into abutment with the stepped portion when an operation is performed.

Effect of the Invention

According to the present invention, because of the aforementioned configuration, a sufficient length for an air passage can be ensured to blow the airflow far in operation, and a highly efficient operation can be configured to be feasible by suppressing a pressure loss at a joint portion between the air passage wall and the air passage extension.

BRIEF DESCRIPTION OF THE DRAWINGS

FIG. 1(*a*) is a cross-sectional view depicting a state in stopping; and FIG. 1(*b*) is a cross-sectional view depicting a state in operation.

FIG. 2(*a*) is a cross-sectional view depicting a state in stopping; and FIG. 2(*b*) is a cross-sectional view depicting a state in operation.

FIG. 3(*a*) is a perspective view depicting a state in stopping; and FIG. 3(*b*) is a perspective view depicting a state in operation.

FIG. 4(*a*) is a perspective view depicting a state in stopping and FIG. 4(*b*) is a perspective view depicting a state in operation.

FIG. 5(*a*) is a perspective view depicting a state in stopping; and FIG. 5(*b*) is a perspective view depicting a state in operation.

FIG. 6(*a*) is a cross-sectional view depicting a state in stopping; and FIG. 6(*b*) is a cross-sectional view depicting a state in operation.

BEST MODE FOR CARRYING OUT THE INVENTION

Hereinafter, in order to describe the present invention in more detail, embodiments for carrying out the invention will be described with reference to the accompanying drawings.

First Embodiment

Figure 1:
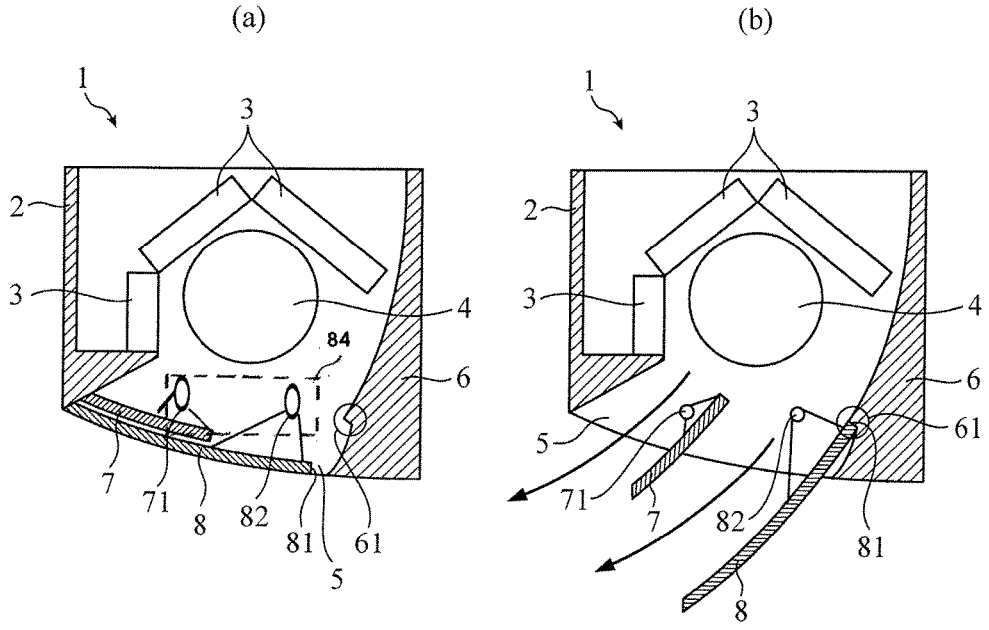
FIG. 1 illustrates a configuration of an air conditioner according to a first embodiment of the present invention.

FIG. 1 illustrates cross-sectional views of a configuration (in stopping and in operation) of an air conditioner 1 according to a first embodiment of the present invention. In FIG. 1, the left side represents the front side of the air conditioner 1, and the right side represents the back side.

As depicted in FIG. 1, a housing 2 of the air conditioner 1 contains a heat exchanger 3 and a fan 4 for sending air that has been heat exchanged by the heat exchanger 3. Additionally, an outlet 5 is provided in the bottom surface of the housing 2 so as to blow air sent from the fan 4 to the outside.

Further, an air passage wall 6 is provided on a back inward-facing surface of the housing 2 so as to guide the air sent from the fan 4 through the outlet 5 to the outside and thus blow an airflow far. A curved surface of the air passage wall 6 is designed according to an optical curvature defined to blow the airflow far. Additionally, provided at a lower portion of the air passage wall 6 is a stepped portion 61 to be abutted by a rear end 81 of an air passage extension 8 to be described later.

Furthermore, a front flap 7 is disposed at the front side of the outlet 5 so as to perform airflow control. The front flap 7 is configured to be rotatable outwardly from the air conditioner 1 about a rotary shaft 71 by a rotary mechanism 84.

Moreover, there is provided the air passage extension 8 that is rotatable about a rotary shaft 82, and that rotates in an opening direction and brings the rear end 81 into abutment with the stepped portion 61 to constitute one curved surface by integration with the air passage wall 6. The air passage extension 8 is configured to be rotatable outwardly from the air conditioner 1 about the rotary shaft 82 by a rotary mechanism (not shown). It is to be noted that a curved surface of the air passage extension 8 is designed in a shape that constitutes one long air passage wall in the case of integrating with the air passage wall 6. Additionally, the air passage extension 8 depicted in FIG. 1 is constituted in a size to cover the entirety of the outlet 5 and the front flap 7 when the air conditioner 1 is stopped and closed.

Next, description is given of an operation of the air conditioner 1 configured as described above.

As depicted in FIG. 1(*a*), when the air conditioner 1 is stopped, the front flap 7 and the air passage extension 8 are rotated in a closing direction about the rotary shafts 71 and 82 by the rotary mechanisms to close the outlet 5. At this time, as depicted in FIG. 1(*a*), the outlet 5 and the front flap 7 are entirely covered with the air passage extension 8, thus providing an aesthetically improved appearance of the air conditioner 1 in stopping.

Meanwhile, as depicted in FIG. 1(*b*), when the air conditioner 1 is operated, the front flap 7 is rotated in the opening direction about the rotary shaft 71 by the rotary mechanism to perform the airflow control. In addition, the air passage extension 8 is rotated in the opening direction about the rotary shaft 82 by the rotary mechanism 84, so as to bring the rear end 81 into abutment with the stepped portion 61 on the air passage wall 6. In this manner, the air passage extension 8 can be integrated with the air passage wall 6 to thereby extend a length of an air passage, which allows an airflow to be blown far. Additionally, at this time, the stepped portion 61 prevents a gap or level difference from being created at a joint portion between the air passage wall 6 and the air passage extension 8, and thus a highly efficient operation with a suppressed pressure loss becomes feasible.

As described above, according to the first embodiment, the configuration includes: the stepped portion 61 that is provided on the side of the outlet 5 of the air passage wall 6; and the air passage extension 8 that has the rotary shaft 82 in the outlet 5, and that rotates in the opening direction about the rotary shaft 82 and brings the rear end 81 into abutment with the stepped portion 61 to constitute the curved surface of a predetermined curvature by integration with the air passage wall 6; thus, a sufficient length for the air passage can be ensured to blow the airflow far in operation, and that the highly efficient operation is configured to be feasible by suppressing the pressure loss at the joint portion between the air passage wall 6 and the air passage extension 8.

It is to be noted that, in the example depicted in FIG. 1, there is shown a case where the air passage extension 8 entirely covers the outlet 5 and the front flap 7 in stopping of the air conditioner 1. However, in a case where the aesthetically pleasing appearance is not particularly desired, the air passage extension 8 does not need to cover entirely the outlet 5 and the front flap 7, and the air passage extension 8 may simply have a length sufficient to blow the airflow far.

Further, while the air passage extension 8 is configured to extend the length for the air passage by integrating with the air passage wall 6 and constituting one curved surface, it can also be used as a mechanism for performing the airflow control when rotationally operated in a predetermined direction like the front flap 7.

Second Embodiment

In a second embodiment, description is given of a configuration in which the length for the air passage is extended by a different feature from that of the first embodiment.

Figure 2:
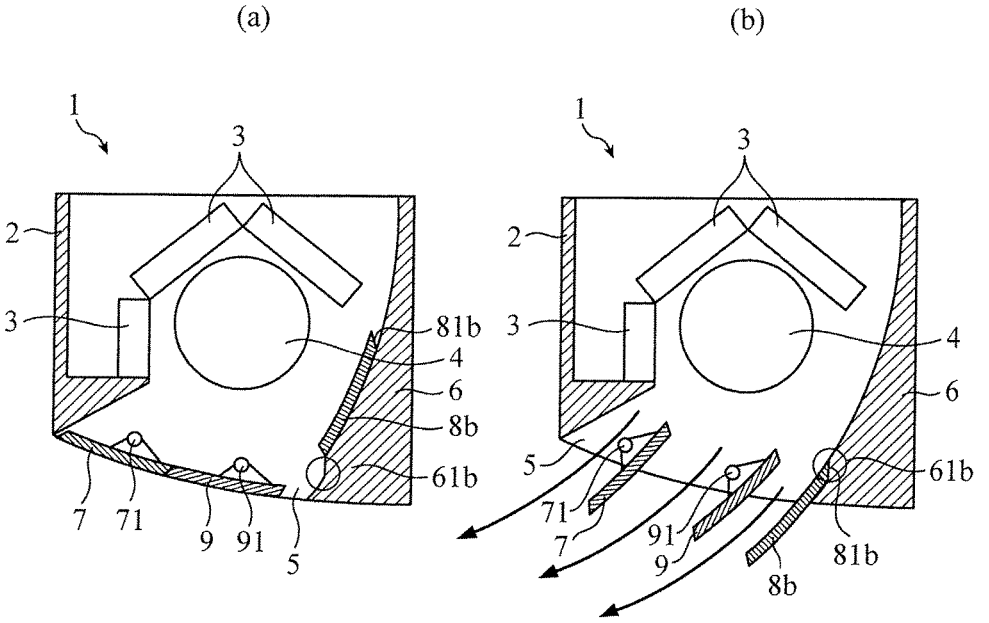
FIG. 2 illustrates a configuration of an air conditioner according to a second embodiment of the invention.

FIG. 2 illustrates a configuration of an air conditioner 1 (in stopping and in operation) according to a second embodiment of the present invention. In the configuration of the air conditioner 1 according to the second embodiment depicted in FIG. 2, the same features as those of the air conditioner 1 according to the first embodiment depicted in FIG. 1 are given identical reference numerals, and the description is focused on different portions.

A front flap 7 is disposed at the front side of an outlet 5 of the air conditioner 1 depicted in FIG. 2 so as to perform airflow control. The front flap 7 is configured to be rotatable outwardly from the air conditioner 1 about a rotary shaft 71 by a rotary mechanism (not shown).

Additionally, a rear flap 9 is disposed at the back side of the outlet 5 so as to perform the airflow control. The rear flap 9 is configured to be rotatable outwardly from the air conditioner 1 about a rotary shaft 91 by a rotary mechanism (not shown).

Further, an air passage extension 8*b* is disposed inside a housing 2 of the air conditioner 1 so as to be movable to the inside and outside of the housing 2, and moves to the outer side of the housing 2 and brings a rear end 81*b* into abutment with a stepped portion 61*b* to constitute one curved surface by integration with an air passage wall 6. The air passage extension 8*b* is configured to be movable to the inside and outside of the housing 2 by moving mechanisms 83 to be described later. It is to be noted that the curved surface of the air passage extension 8*b* is designed in a shape that constitutes one longer air passage wall in the case of integrating with the air passage wall 6.

Additionally, the stepped portion 61*b* on the air passage wall 6 depicted in FIG. 2 is constituted with a slope shape so as to allow the air passage extension 8*b* to move smoothly. Then, the bottom surface on the side of the rear end 81*b* of the air passage extension 8*b* is also constituted with a slope shape corresponding to the shape of the stepped portion 61*b*.

Next, the moving mechanisms 83 of the air passage extension 8*b* are described with reference to FIG. 3.

Figure 3:
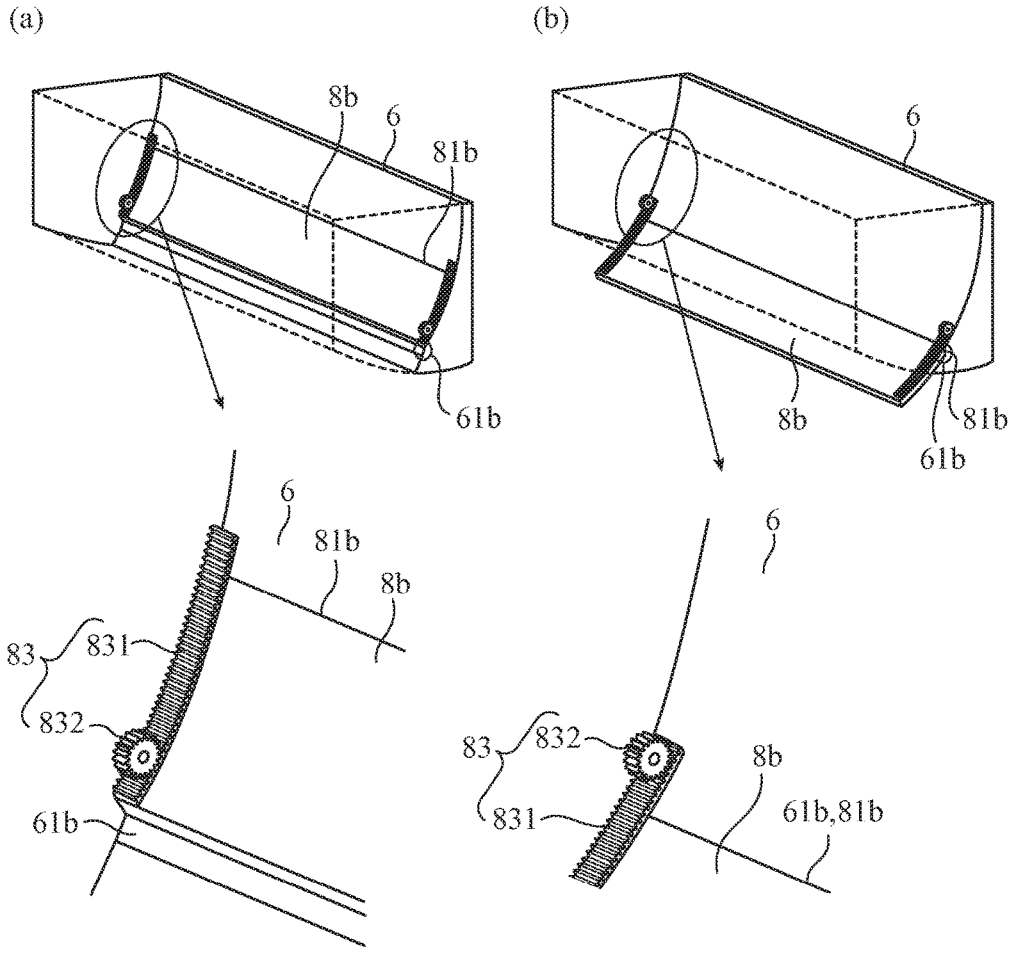
FIG. 3 illustrates a configuration of a moving mechanism of an air passage extension of the second embodiment of the invention.

As depicted in FIG. 3, the moving mechanisms 83 are disposed at two ends of the air passage extension 8*b* in a widthwise (longitudinal) direction so as to move the air passage extension 8*b* to the inside and outside of the housing 2.

The moving mechanisms 83 depicted in FIG. 3 each consist of a linear rack portion 831 that is disposed on the upper surface of the air passage extension 8*b*, and a gear portion 832 to mesh with the rack portion 831. The gear portions 832 are fixed in a position, and rotated in a predetermined direction by a motor (not shown) connected thereto to thus move the air passage extension 8*b* in a predetermined direction through the rack portions 831.

Next, description is given of an operation of the air conditioner 1 configured as described above.

As depicted in FIG. 2(*a*), when the air conditioner 1 is stopped, the front flap 7 and the rear flap 9 are rotated in a closing direction about the rotary shafts 71 and 91 by the rotary mechanisms to close the outlet 5. Further, as depicted in FIGS. 2(*a*) and 3(*a*), the air passage extension 8*b* is moved to the inner side of the housing 2 (on the surface of the air passage wall 6) by the moving mechanisms 83 to be housed in the housing 2. In this manner, the air passage extension 8*b* is put in a state housed in the housing 2 in stopping of the air conditioner 1 is stopped, and thus the appearance is not aesthetically impaired.

Meanwhile, as depicted in FIG. 2(*b*), when the air conditioner 1 is operated, the front flap 7 is rotated in the opening direction about the rotary shaft 71 by the rotary mechanism, and the rear flap 9 is rotated in the opening direction about the rotary shaft 91 by the rotary mechanism, so as to each perform airflow control. Further, as depicted in FIGS. 2(*b*) and 3(*b*), the air passage extension 8*b* is moved to the outer side of the housing by the moving mechanisms 83, so as to bring the rear end 81*b* into abutment with the stepped portion 61*b* on the air passage wall 6. This allows the air passage extension 8*b* to integrate with the air passage wall 6, so as to extend a length for an air passage, which makes it possible to blow an airflow far. Additionally, at this time, the stepped portion 61*b* prevents a gap or level difference from being created at a joint portion between the air passage wall 6 and the air passage extension 8*b*, and thus a highly efficient operation with a suppressed pressure loss becomes feasible.

As described above, according to the second embodiment, the same advantageous effects as those of the first embodiment are obtained by a configuration including: the stepped portion 61*b* that is provided on the side of the outlet 5 of the air passage wall 6; and the air passage extension 8*b* that is movable to the inside and outside of the housing 2, and that moves to the outer side of the housing 2 and brings the rear end 81*b* into abutment with the stepped portion 61*b* to constitute the curved surface of a predetermined curvature by integration with the air passage wall 6.

Incidentally, in the above FIG. 3, the rack portions 831 and the gear portions 832 are used as the moving mechanisms 83, but the configuration is not limited thereto. For example, a configuration as depicted in FIG. 4 and FIG. 5 may be adopted.

Figure 4:
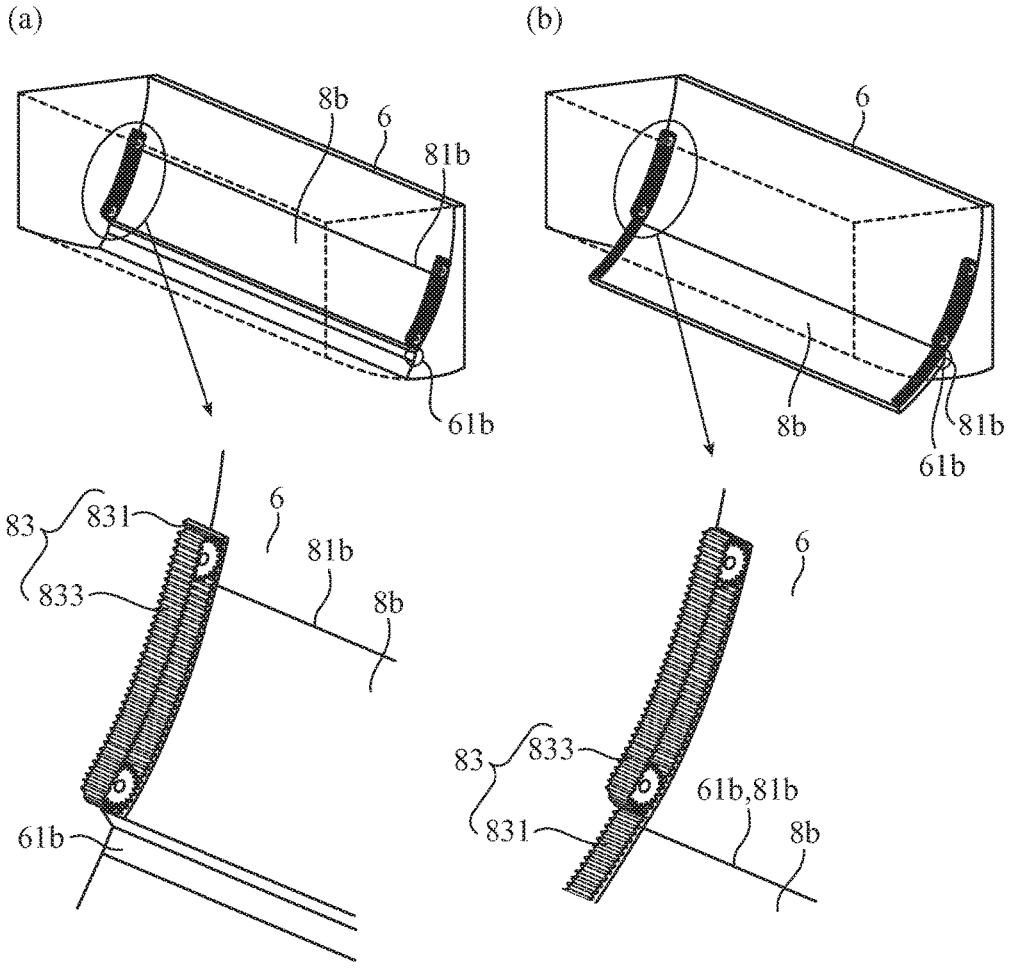
FIG. 4 illustrates another configuration of a moving mechanism of the air passage extension of the second embodiment of the invention.

The moving mechanisms 83 depicted in FIG. 4 use belt conveyors 833 to mesh with the rack portions 831 in place of the gear portions 832. The belt conveyors 833 are fixed to a position and are rotated in a predetermined direction by a motor (not shown) connected thereto, so as to move the air passage extension 8*b* in a predetermined direction through the rack portions 831. In the moving mechanisms 83 depicted in FIG. 3, it is necessary that the rack portions 831 be extended rearward as installed positions of the gear portions 832 becomes away from the stepped portion 61*b*, while it is not necessary any longer that the rack portions 831 be extended by using the belt conveyors 833 as depicted in FIG. 4.

Figure 5:
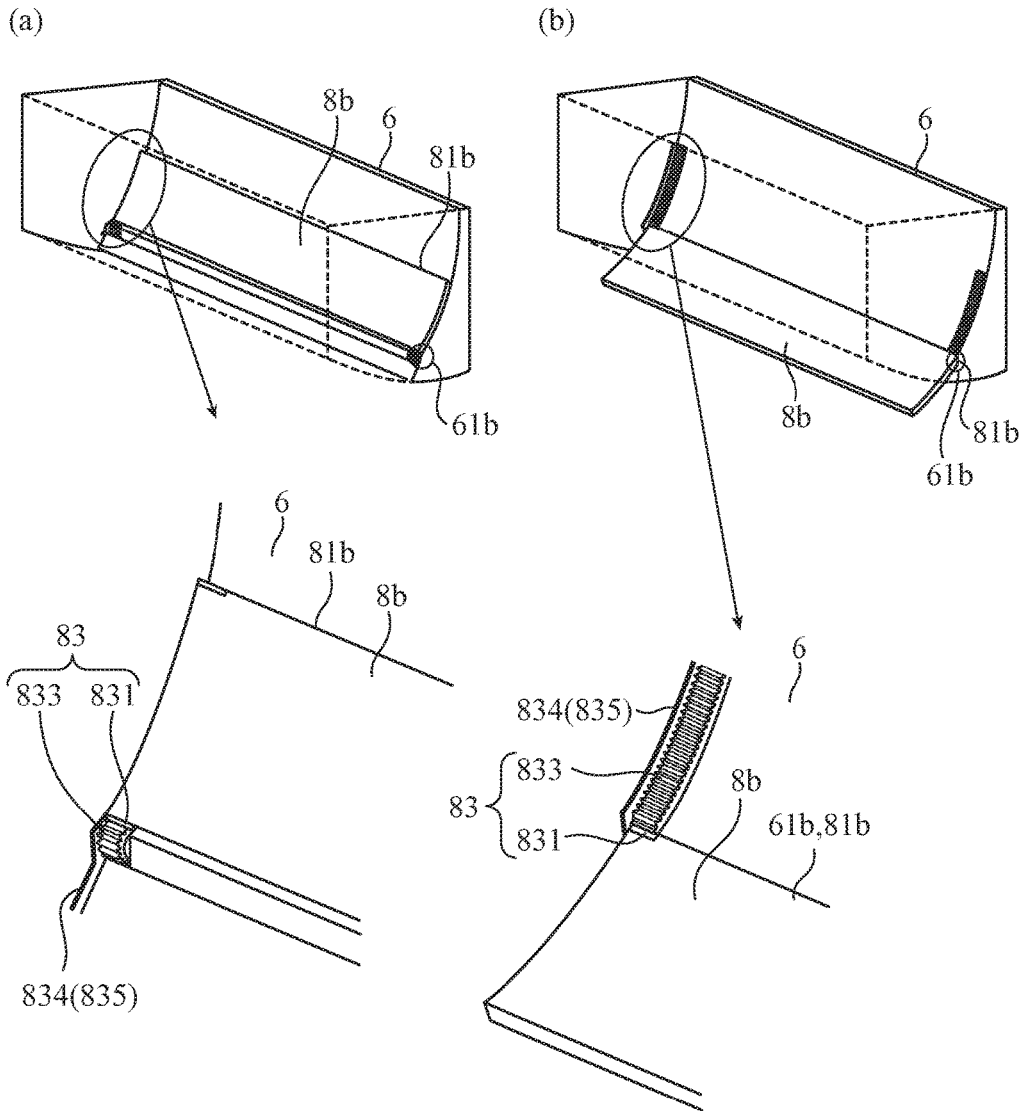
FIG. 5 illustrates still another configuration of a moving mechanism of the air passage extension of the second embodiment of the invention.
Figure 6:
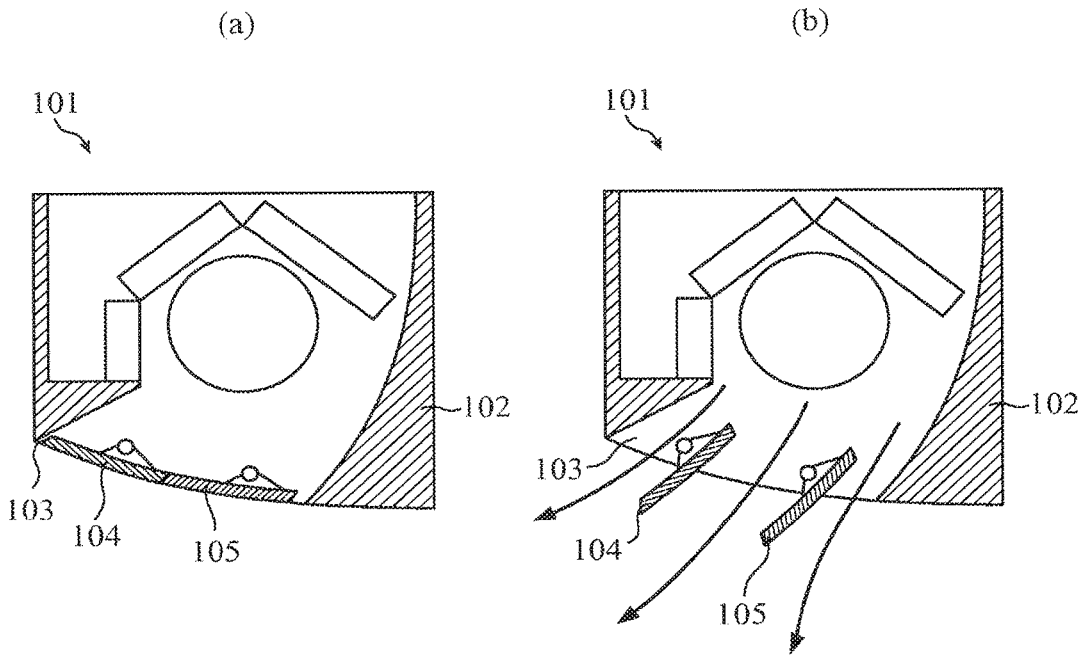
FIG. 6 illustrates a configuration of a conventional air conditioner.

Further, moving mechanisms 83 depicted in FIG. 5 each are configured to include a rack portion 831 that is disposed from the bottom surface of the air passage extension 8*b* along the rear surface, a belt conveyor 833 to mesh with the rack portion, and a guide mechanism 834 that regulates movement of the air passage extension 8*b*. The guide mechanisms 834 include shafts (not shown) disposed at two ends in the widthwise direction of the air passage extension 8, respectively, and guide grooves 835 to engage with the shafts. In the moving mechanisms 83 depicted in FIG. 3 and FIG. 4, it is necessary that the stepped portion 61*b* and the rear end 81*b* of the air passage extension 8*b* be constituted with the slope shape; however, it is not necessary any longer that the stepped portion 61*b* and the rear end 81*b* of the air passage extension 8*b* be constituted with the slope shape with the use of the guide mechanisms 834 as depicted in FIG. 5. Further, in FIG. 5, the belt conveyors 833 may be changed to the gear portions 832.

Incidentally, the invention of the present application allows free combination of the embodiments or modification of any components in the embodiments, or omission of any components in the embodiments within the scope of the invention.

INDUSTRIAL APPLICABILITY

The air conditioner according to the present invention includes: the stepped portion provided on the side of the outlet of the air passage wall; and an air passage extension that has the rotary shaft in the outlet, and that rotates in the opening direction about the rotary shaft and brings the end into abutment with the stepped portion to constitute the curved surface of a predetermined curvature by integration with the air passage wall, and thus the sufficient length for the air passage can be ensured to blow the airflow far in operation, and the highly efficient operation can be achieved by suppressing the pressure loss at the joint portion between the air passage wall and the air passage extension; it is thus suitably applied to the air conditioner that guides air to the outside through the outlet by the air passage wall.

DESCRIPTION OF REFERENCE NUMERALS and SIGNS

1 Air conditioner
2 Housing
3 Heat exchanger
4 Fan
5 Outlet
6 Air passage wall
7 Front flap
8, 8*b* Air passage extension
9 Rear flap
61, 61*b* Stepped portion
71 Rotary shaft
81, 81*b* Rear end
82 Rotary shaft
83 Moving mechanism
91 Rotary shaft
831 Rack portion
832 Gear portion
833 Belt conveyor
834 Guide mechanism
835 Guide groove.

The invention claimed is:

1. An air conditioner including a fan disposed inside a housing and that sends air, an outlet provided in a bottom surface of the housing, and an air passage wall that is provided inside the housing and that guides the air sent from the fan through the outlet to the outside, the air conditioner comprising:

a stepped portion provided on a side of the outlet of the air passage wall;

an air passage extension that has a first rotary shaft in the outlet, and that rotates in an opening direction about the first rotary shaft to constitute a curved surface of a predetermined curvature by integration with the air passage wall, the first rotary shaft being spaced away from the air passage wall in a direction generally orthogonal to the direction of airflow along the air passage extension;

a rotary mechanism that rotates the air passage extension when an operation is performed; and a flap that has a second rotary shaft arranged generally parallel to the first rotary shaft and provided in the outlet to guide the air sent from the fan to the outside, and that is entirely covered with the air passage extension from a blowing side when the air passage extension is closed.

* * * * *